United States Patent [19]

Leib

[11] Patent Number: 4,595,235

[45] Date of Patent: Jun. 17, 1986

[54] PATIENT'S DEFINED-MOTION CHAIR

[76] Inventor: Roger K. Leib, 515 S. Crocker St., Los Angeles, Calif. 90013

[21] Appl. No.: 368,521

[22] Filed: Apr. 15, 1982

Related U.S. Application Data

[63] Continuation-in-part of Ser. No. 248,852, Mar. 30, 1981, which is a continuation-in-part of Ser. No. 110,340, Jan. 7, 1980, abandoned.

[51] Int. Cl.[4] ..... A47C 3/00

[52] U.S. Cl. ..... 297/294; 297/285; 297/411; 297/445; 297/DIG. 10

[58] Field of Search ..... 297/288, DIG. 10, 294, 297/445, 286, 411, 412, 285, 452

[56] References Cited

U.S. PATENT DOCUMENTS

| | | | |
|---|---|---|---|
| Re. 20,372 | 5/1937 | Lorenz | 297/288 |
| D. 252,901 | 9/1979 | Peterson | D6/72 |
| D. 262,502 | 1/1982 | Wilson | D6/56 |
| 693,323 | 2/1902 | Gritton . | |
| 1,791,453 | 2/1931 | Mies . | |
| 1,928,939 | 10/1933 | Larsen | 297/295 |
| 1,950,226 | 3/1934 | Cable . | |
| 1,979,073 | 10/1934 | Larsen . | |
| 2,064,137 | 12/1936 | Zerbee . | |
| 2,069,456 | 2/1937 | McGowen | 297/287 |
| 2,071,084 | 2/1937 | Nolan | 297/295 |
| 2,121,130 | 6/1938 | McGowen . | |
| 2,135,657 | 11/1938 | Church . | |
| 2,186,705 | 10/1936 | Lorenz . | |
| 2,586,262 | 2/1952 | Robins | 297/294 X |
| 2,625,205 | 1/1953 | Holmes | 297/295 |
| 2,679,893 | 1/1954 | Bennett | 297/282 |
| 2,699,200 | 1/1955 | Lingle . | |
| 3,082,417 | 6/1963 | Drabert | 297/291 |
| 3,147,997 | 9/1964 | Mason | 297/452 |
| 3,259,427 | 7/1966 | Weist | 297/DIG. 10 |
| 3,343,871 | 9/1967 | Yates et al. | 297/DIG. 10 |
| 3,379,450 | 4/1968 | Jones et al. | 297/DIG. 10 |
| 3,762,769 | 10/1973 | Poschl | 297/284 |
| 3,815,955 | 6/1974 | Gibilterra | 297/295 |
| 3,876,250 | 4/1975 | Eberle | 297/446 |
| 4,049,315 | 9/1977 | Jacobson | 297/447 |

FOREIGN PATENT DOCUMENTS

| | | | |
|---|---|---|---|
| 560673 | 9/1932 | Fed. Rep. of Germany | 297/294 |
| 869114 | 3/1953 | Fed. Rep. of Germany | 297/288 |
| 764919 | 3/1943 | France | 297/288 |
| 529845 | 8/1955 | Italy | 297/295 |
| 74283 | 5/1932 | Sweden | 297/295 |

OTHER PUBLICATIONS

"Patient Rocking Chair"—Hospitals Magazine, Jun. 1, 1980.

"Chair"—Health Care Product News, Aug. 1980.

"Special Seating"—Contract Magazine, Nov. 1980.

*Primary Examiner*—James T. McCall

*Attorney, Agent, or Firm*—Sheldon & Mak

[57] ABSTRACT

A chair, especially suited for use by sitters lacking in normal strength which provides a rocking motion without shifting the base of the chair, and which provides support and assistance to the sitter in exiting the chair, is described.

5 Claims, 5 Drawing Figures

PATIENT'S DEFINED-MOTION CHAIR

This application is a continuation-in-part of co-pending application Ser. No. 248,852 filed Mar. 30, 1981, which is a continuation-in-part of U.S. Ser. No. 110,340 filed Jan. 7, 1980, now abandoned.

BACKGROUND

This invention relates to a chair which because of its characteristics and construction, as will be described, facilitates use by weakened, partially disabled, or infirm users suffering a variety of ailments in a manner constituting a distinct improvement over patient-type chairs of the prior art. Because of the comforts it provides, the chair of the invention also is appropriate for the seating needs of healthy users, and it is also a distinct improvement over chairs of the prior art for general seating use.

An important feature of this chair is its ability to provide a defined motion pattern in response to the body pressure of the user, such that the motion constitutes a controlled pattern and a relaxing sensation for the user.

There are many chair configurations which have found use in the hospital room, nursing home, extended care facility, sick room at home or as loungers for general use. No chair now available has the desirable motion characteristics of the chair described herein.

A major drawback of presently available chairs is the widespread problem of weakened users being unable to get out of the usual easy, or lounge, chairs by themselves because they haven't the strength to do so in the particular groups of muscles called into play by the configuration of the chair they were trying to get out of (typically the arm and upper body muscles). The problem is compounded by the relatively widespread incidence of back problems common among nurses and aides because of their having through their shift to help patients or wards out of chairs and into standing positions. One object of the invention is to provide a chair which enables the user to utilize his strongest muscles (usually leg muscles) for rising up out of the chair, by providing, in effect, a catapulting motion to the user.

Another problem with prior art chairs used in health care settings is the lack of seated comfort they provide. A major factor in this discomfort is the stationary aspect of the seating. Provision for some form of effortless motion prevents the concentration of pressure points at specific locations on the body which contact the chair and support weight.

This aspect of seating discomfort is caused by the inevitable concentration of body weight on specific portions of flesh. Under normal conditions of health and mobility, such pressure results in the desire to shift body weight and redistribute the pressure. However, in a weakened state and in a static chair, patients may be unable to do so. In the present invention, the natural motion of the chair provides relief.

Thus, an object of the present invention is to provide a chair in which slight rocking motion can be achieved, which provides an opportunity for exercise to the debilitated user; and which also allows the constant partial shifting and redistribution of body weight and helps the patient to dissipate institutionally and health-related anxieties by moving and rocking.

A problem with chairs of the prior art that accommodate a rocking motion by the user, is that the axis of rotation usually falls somewhere between the user's knees and pelvis, so that as the user rocks backward, there is a tendency for the knees to move upwardly, causing the feet to leave the floor and creating an excess of pressure on the underside of the thighs. In addition, there is a further tendency in the prior art chairs, as the user pushes downward on the fronts of armrests in order to lift himself upwardly, for the armrest fronts to rotate downwardly, opposite the direction in which the user is trying to push. Thus, another object of the present invention is to provide a chair with a rocking motion, the axis of which is located in front of the knees, and armrest fronts remain stable while the body rotates backward into the chair back; and one that has no tendency to rock forwardly when the user pushes down on the armrests to lift himself out of the chair.

Yet another problem with many prior art chairs used in health care settings in the manner in which impact is absorbed when a user drops into the seat. The most common means of absorbing impact shock is with heavy padding, which besides its potentially hygienic limitations, if effective, often permits the sitter to sink too low to be able to lift himself out of the chair easily, and creates both bulk and weight which limit an institutional staff's ability to move the chair and adequately perform necessary floor maintenance operations.

Such stuffing materials also often create fire hazards by the use of highly combustible materials which generate high smoke density and toxicity on combustion. A further object of the present invention is to provide a chair of minimum required bulk which permits minimal use of materials that would fuel a fire and the structure of which absorbs initial impact by the user.

The objects of the present invention are accomplished by providing a chair which is primarily though not exclusively intended for use by the weakened, partially disabled, or infirm user such as are typically found in hospitals, nursing homes, extended care facilities, and sickrooms, and which is directed primarily at the geriatric, orthopedic, rehabilitating, psychiatric, and maternity patient. It is particularly suited to these applications in that it is easy to enter and exit, provides with no moving parts a soothing slight rocking motion that increases rearwardly in order to shift and redistribute body weight without lifting the feet off the floor while maintaining stable arm fronts against which to push in exiting, minimizes skeletal shock upon sitting impact without padding of any kind which might potentially fuel a fire, and remains stable in all normal use.

The chair as described above consists of a tubular or barstock steel base frame, vertical leg components which support tubular or bar stock steel side frames which in turn support a seat and back member constructed of flexible material. The seat and back member may be formed of any suitable upholstery material, and the chair may be constructed so that the seat and back member may be removed for replacement purposes.

A major advantage of the chair is the placement and support of armrests. They are axially supported at their front end by a relatively rigid member so all downward force exerted at their front ends is resisted by the vertical legs of the chair acting as axial struts, thus providing the user a stable stratum against which to push for exiting the chair. Furthermore, these armrests extend well past the seat front, enabling the user to first pull himself far forward enough so that he is then pushing downwardly over the center of gravity of his feet enabling his leg muscles to perform a substantially higher proportion of the work than his arm and upper body muscles would otherwise have had to perform.

Another advantage is that portions of the seat and back that actually support the user's weight are a structurally efficient tensile sling, allowing use of a minimal amount of material in one thin layer. As shown in one embodiment, this sling consists of an open polyester mesh which provides both full ventilation to the user and complete washability. The amount of material required is so minimal, in fact, that it dries quickly without trapping water and contributes so little potential fuel that it is not subject to present flammability laws governing upholstered furniture.

Another advantage of the chair is the seated comfort it provides. The front-cantilevered side frames deflect rearwardly, leaning the user back into the chair with a slight but soothing rocking motion which further shifts concentration of the user's body weight to different tissue areas as his center of gravity shifts correspondingly back and forth. Since the point of fixing of the flexing cantilevered side frames is at their front end, the corresponding axis of rotation of side frames is just above and in front of the knees, which therefore remains relatively stable so there is no lifting off the floor of the user's feet.

Furthermore, the optimally placed lumbar support gives adequate support to the critical lumbar region, while the headrest can be adjusted up or down via hook and loop tape fasteners to correspond with the small of the neck within the range limited by its permanently sewn attachment straps. And as the user drops into the chair, the flexure of the side frames absorbs impact and prevents skeletal shock, for which heavy padding might otherwise be needed.

The elimination of the need for heavy padding thus produces a less bulky chair which can be moved more easily for cleaning, relocation, or even patient transport.

Yet another advantage of the chair is that the portions of the base that are on the floor are sized large enough so that the user's center of gravity always falls within those boundaries delineated by the base, thus precluding any instability in normal use.

Finally, the skeletal nature permitted by the chair's structure permits the attachment of a multitude of accessories to accommodate the treatments or functions not normally performed in a lounge chair.

DETAILED DESCRIPTION

Figure 2:
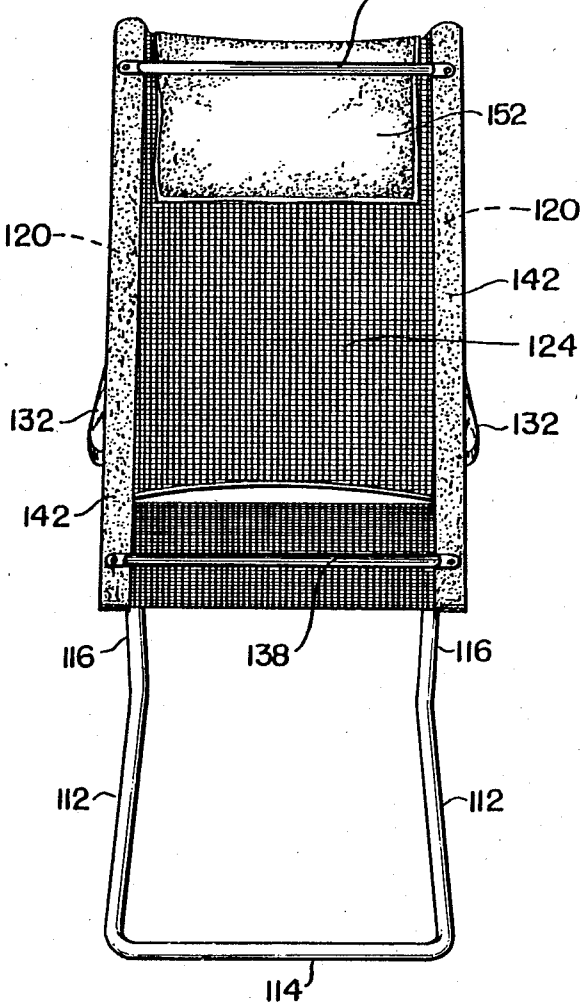
FIG. 2 is a rear view of same.
Figure 1:
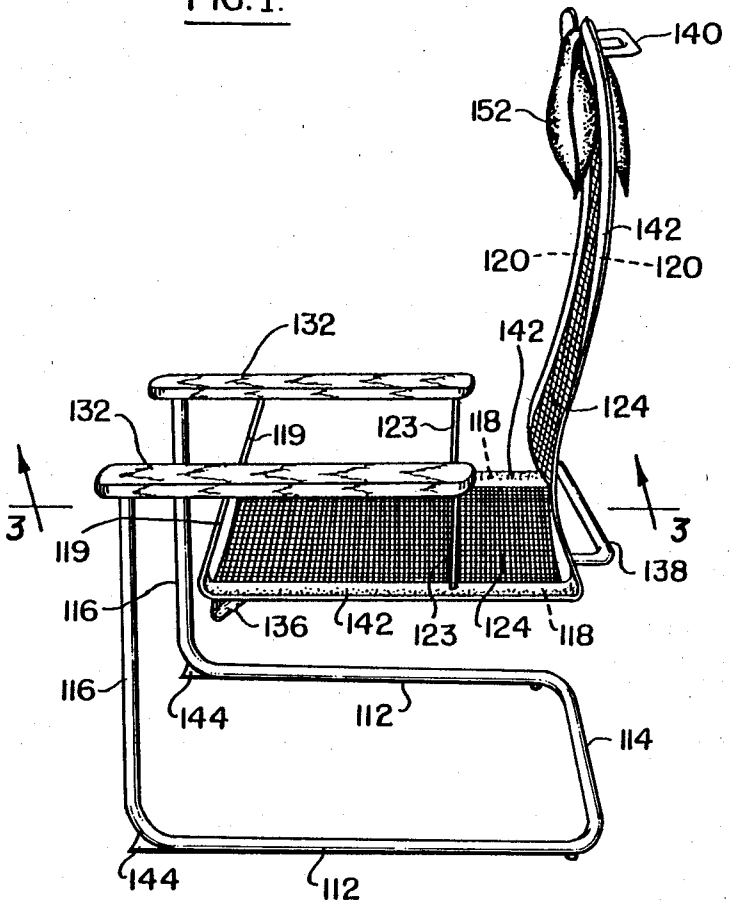
FIG. 1 is a side or perspective view of a preferred embodiment of the chair of the present invention.
Figure 3:
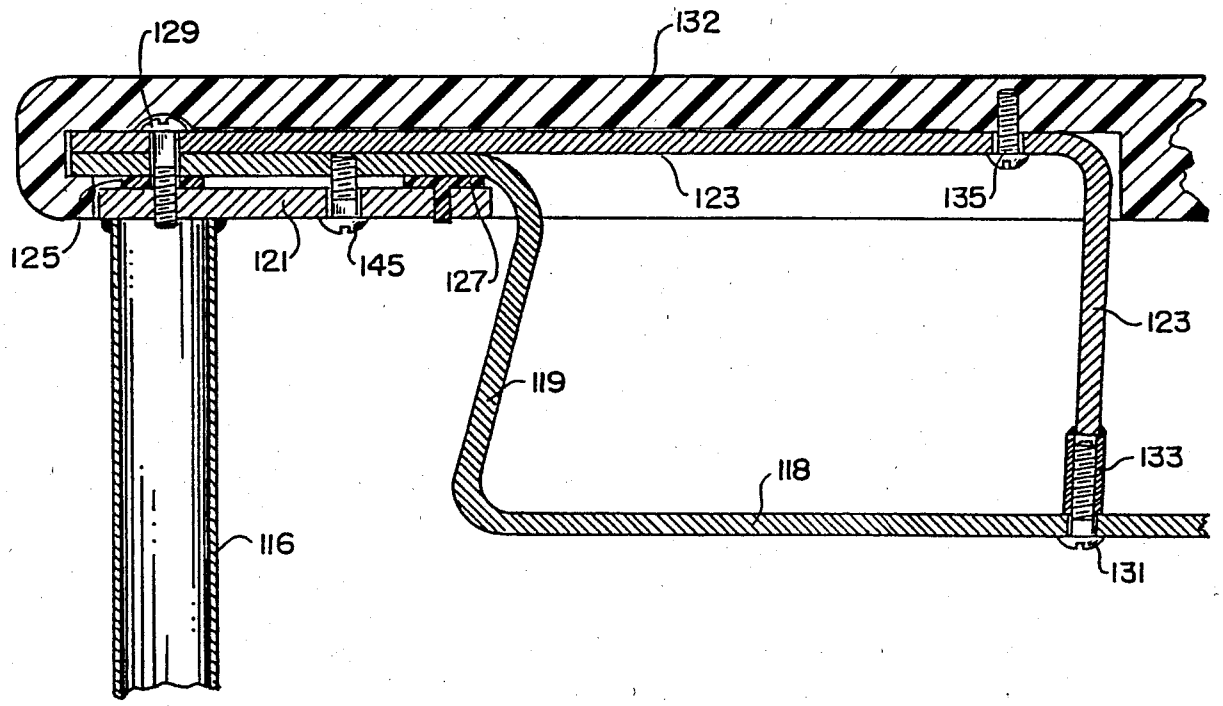
FIG. 3 is an enlarged sectional view of the arm assembly of the chair of FIG. 1, taken along the line 9—9 of FIG. 1.

In a preferred embodiment shown in FIGS. 1, 2, and 3, the construction comprising seat and back supporting structures of the chair of the present invention is effectively cantilevered from flat plates atop the upright front leg supporting members. This results in a flexibility of support which permits the user to "rock" in a fashion not possible in ordinary rocking chairs.

The composite of the cantilevered seat and back supporting structure attached rigidly to the flat plates atop the front upright supports results in a vertical deflection of the seat and back support assembly of 0.5 inches or more at a point measured 12 inches horizontally back from the seat front under a load of 100 lbs. placed 12 inches horizontally back from the seat front. A horizontal deflection of ⅜ inch or more measured 12 inches vertically from the seat is associated with the vertical deflection, under a 50 lb. load directed horizontally at a point 12 inches vertically above the seat. The period of these deflections is 0.20 second or more, i.e., an undamped primary elastic period of vibration along the plane of the seat.

In the embodiment of FIGS. 1, 2 and 3, the chair includes a base formed, for example, of tubular steel. The base has two spaced and parallel side sections 112, a transverse section 114, and two spaced and parallel upright legs 116 at the forward end thereof. As shown in FIG. 3, the upper end of each of the legs 116 is welded to an elongated flat plate 121 which may be formed of flat high-strength steel bar stock. The steel plates provide mounting for two spaced and parallel side members 118 which constitute the seat supporting section of the chair, and two spaced and converging side members 120 which contitute the back supporting section of the chair. The steel frame members 118, 120 are held spaced apart in position by three transverse bars 136, 138 and 140.

The two seat-supporting frame side members 118 also each have a forward Z-shaped section 119 which, as shown in FIGS. 1 and 3 extends upwardly from the corresponding frame member 118 and under a corresponding arm rest 132. The frame members 118 and 120, and section 119, and strip 123 on each side of the chair constitute a cantilevered leaf-spring assembly capable of being deflected with respect to leg 116 through a substantial range as set forth above without permanent distortion or set. These members likewise may be formed of flat steel barstock, heat treated to have spring action mechanical properties. As shown in FIG. 3, the forward end of each section 119 extends between a steel plate 121 welded to the upper end of leg 116, and an L-shaped steel strip 123. The purpose of the L-shaped steel strip 123 is to pull down the rear end of the arm rest 132 when the seat is deflected downwardly and to give added strength to the seat-supporting frame member 118 so that the combination of members will have additional loadbearing capacity. Soft rubber spacers 125 and 127 are provided between the plate 121 and section 119 in order to enhance the apparent resiliency of member 118 and to prevent the sharp upper rear corner of member 121 from creating a point of concentrated stress on frame member 118 at their point of contact.

Section 119 is secured to plate 121 by a bolt 129, and the rear end of strip 123 is secured to member 118 by a bolt 131 which is received in a threaded sleeve 133 welded into the end of strip 123. Arm rest 132 is held in place at its rear end by a nut and bolt 135, the head of which is embedded in the armrest, and at its front end by overlapping the section 119 and strip 123. A bolt 145 limits the motion of section 119 relative to plate 121 in order to preclude prying the head off bolt 129, and to keep member 118 and plate 121 in parallel alignment.

By pulling forward and then up on the armrest 132, the front of the armrest may be pulled over and disengaged from section 119 and strip 123, giving access to the head of bolt 129. Tightening or loosening the bolt 129 against the soft rubber spacers 125, 127 adjusts the angle of inclination of frame member 118 (the inclination of the seat) to accommodate more exactly to various patient weights by increasing the height of the rear of the seat for heavier patients.

The assembly described above provides a strong support for the seat of the chair and yet provides for the resilient rocking action by the occupant. Optionally, and preferably, the members 112 and 116 form an open front so that an ottoman may be slid and stored under the chair.

A member constructed of appropriate flexible material 124 wraps around and is supported on the side frame members 118 and 120 to constitute the seat and back of the chair.

If desired a head cushion 152 may be adjustably attached to the back, for example, by appropriately sewn and located limiting straps and hook and loop fastener tape. For additional stability, a pair of members 144, formed of plastic or other appropriate material may be attacted to the forward end of the base, as shown, to prevent forward tipping of the chair and to prevent the chair from sliding when the patient is getting up out of the chair.

Figure 5:
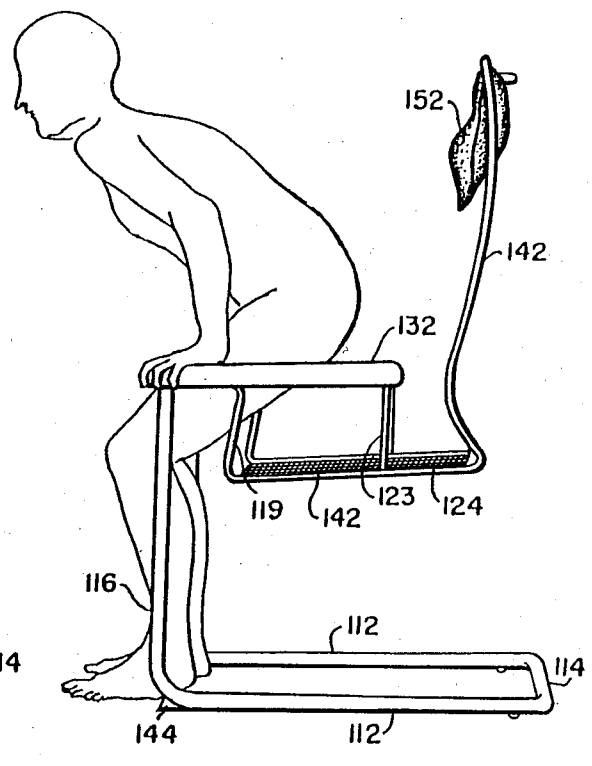
FIG. 5 is a side elevation showing how a user, having first pulled himself forward, can push vertically down over the center of his feet thus calling his leg muscles into play in rising out of the chair into a standing position.
Figure 4:
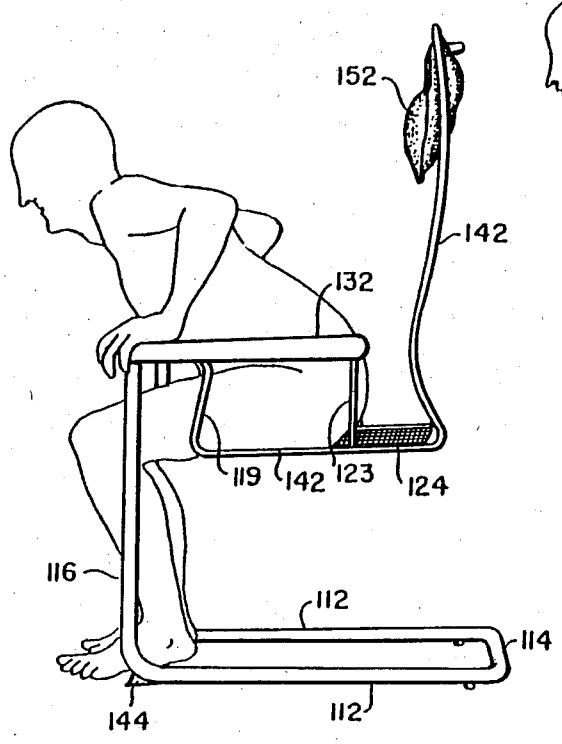
FIG. 4 is a side elevation of the chair of FIG. 1 under loading in normal use.
Figure 4:
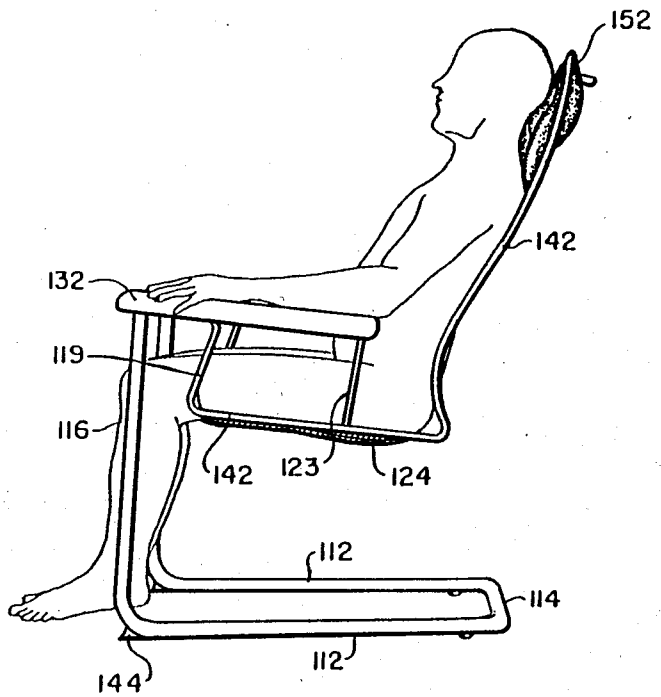

It should be noted that the forward edge of the seat is displaced rearwardly of the legs 116 by a substantial amount to assist the sitter in getting out of the chair because by pressing down on the forward ends of the arm rests 132 against the top of the rigid legs 116, he is pushing axially over the lower part of his legs and the center of gravity of his feet, bringing his leg muscles into play in rising out of the chair, as shown in FIGS. 4 and 5.

Thus, in combination with the flexible chair structure, the arms of the sitter, when gripping the armrest fronts, form radial arms with the sitter's hands at the fulcrum, about which the shoulders and upper body of the sitter move in an arc toward the standing portion. This can be achieved in part, by the position of the armrest fronts in relation to the weight focus of the sitter, i.e., the position of the armrest fronts is set at least 15 inches forward of the seat/back interface and substantially even with the upright members as shown in FIGS. 4 and 5. This is also aided by the catapult-like action of the flexible seat/back structure.

It will be appreciated that while particular embodiments of the invention have been shown and described, modifications may be made, including both a high-backed version and a low-backed version, and it is intended in the following claims to cover all the embodiments which come within the true spirit and scope of the invention.

What I claim is:

1. A chair comprising a substantially rigid base and a pair of spaced substantially rigid supporting members rigidly attached to and extending upwardly from the base, the chair having seat and back members, wherein the seat and back members are rearwardly cantilevered from the tops of the supporting members, the tops of the supporting members being located above the seat member so as to achieve a natural rearwardly increasing rocking motion about a horizontal axis above the seat member in response to the weight of a person sitting in the chair.

2. The chair of claim 1 in which the supporting members are located in front of the seat member and the horizontal axis is in front of the seat for rocking without instability.

3. The chair of claim 1, which chair can acheive a vertical deflection of 0.5 inches or more at a point measured 12 inches horizontally back from the seat member front under a load of 100 pounds placed twelve inches measured horizontally back from the seat member front, and a horizontal deflection of $\frac{5}{8}$ inch or more at a point measured 12 inches vertically up from the seat member with a 50-lb. load directed horizontally toward the rear from a point measured vertically 12 inches up from the seat member, and an undamped primary elastic period of vibration along the plane of the seat member of 0.20 second or more.

4. A chair capable of a rocking motion comprising:

(a) a substantially rigid base having a front pair of spaced upright legs;

(b) a pair of substantially horizontal arm rests extending rearwardly from the upper ends of the legs;

(c) mounting means at the upper end of each leg for cantilevered attachment of the respective arm rests;

(d) a body support having a substantially horizontal seat and a back extending upwardly from the rear of the seat; and (e) means for attaching the seat in a fixed relation below the arm rests;

wherein the mounting means are located higher than and farther forward than the seat so that the seat rocks together with the arm rests with respect to the legs about a front horizontal axis above the seat without instability, which chair can achieve a vertical deflection of 0.5 inches or more at a point measured 12 inches horizontally back from the seat front under a load of 100 pounds placed twelve inches measured horizontally back from the seat front, and a horizontal deflection of $\frac{5}{8}$ inch or more at a point measured 12 inches vertically up from the seat with a 50-lb. load directed horizontally toward the rear from a point measured vertically 12 inches up from the seat and an undamped primary elastic period of vibration along the plane of the seat of 0.20 second or more.

5. A chair capable of a rocking motion comprising:

(a) a substantially rigid base having a front pair of spaced apart upright legs;

(b) a pair of substantially horizontal arm rests extending rearwardly from the upper ends of the legs;

(c) mounting means at the upper end of each leg for cantilevered attachment of the respective arm rests, each mounting means comprising:

(i) a support welded to a respective one of the legs and extending rearwardly therefrom;

(ii) clamp means for fastening a respective arm rest to the support, the clamp means supporting an upward load component of the arm rest;

(iii) a resilient spacer on the support rearward of the clamp means, the resilient spacer supporting a corresponding downward load component of the arm rest for adding flexibility to the flexible mount;

(d) a body support having a substantially horizontal seat and a back extending upwardly from the rear of the seat, the front of the seat being rearward of the legs, the body support comprising a pair of oppositely disposed, elongated flexible body-supporting members each comprising a seat-supporting section at the seat, a back-supporting section at the back, curved for providing lumbar support corresponding to the flexing of the body-supporting members, and an extension section forward of the seat, the extension section being attached to the mounting means of a corresponding arm rest; and (e) a pair of substantially vertical support members each connecting a corresponding body-supporting member to a corresponding arm rest at a location behind the front of the seat, wherein the tension members cooperate with the extension sections of the body-supporting members for maintaining the seat in a fixed relation below the arm rests; and wherein the seat and the arm rests rock with respect to the legs about a front horizontal axis above the seat, the legs alone are capable of supporting the arm rests and the body support, and the clamp means includes an adjustment for inclining the seat for different seat back elevation and rocking characteristics, which chair can achieve a vertical deflection of 0.5 inches or more at a point measured 12 inches horizontally back from the seat member front under a load of 100 pounds placed twelve inches measured horizontally back from the seat member front, and a horizontal deflection of $\frac{5}{8}$ inch or more at a point measured 12 inches vertically up from the seat member with a 50-lb. load directed horizontally toward the rear from a point measured vertically 12 inches up from the seat member, and an undamped primary elastic period of vibration along the plane of the seat member of 0.20 second or more.

* * * * *